United States Patent [19]

Stahlecker et al.

[11] Patent Number: 5,069,027

[45] Date of Patent: Dec. 3, 1991

[54] TANGENTIAL BELT DRIVE FOR SPINNING OR TWISTING MACHINES

[75] Inventors: Fritz Stahlecker, Josef-Neidhart-Strasse 18, 7347 Bad Überingen; Gerd Stahlecker, Eislingen/Fils, both of Fed. Rep. of Germany

[73] Assignees: Fritz Stahlecker; Hans Stahlecker, both of Fed. Rep. of Germany

[21] Appl. No.: 379,977

[22] Filed: Jul. 14, 1989

[30] Foreign Application Priority Data

Aug. 11, 1988 [DE] Fed. Rep. of Germany ..... 3827234

[51] Int. Cl.[5] ..... D01H 4/42; D01H 13/00

[52] U.S. Cl. ..... 57/264; 57/104; 474/104

[58] Field of Search ..... 57/78, 88, 104, 105, 57/264, 104; 474/101, 102, 104; 226/18, 19, 20, 21

[56] References Cited

U.S. PATENT DOCUMENTS

| | | | |
|---|---|---|---|
| 1,791,288 | 2/1931 | Scheweitzer | 226/21 |
| 2,718,156 | 9/1955 | Wright | 474/102 |
| 3,313,461 | 4/1967 | Andersen | 226/20 |
| 3,461,660 | 8/1969 | Nimtz et al. | 57/105 |
| 3,545,599 | 12/1970 | Smith et al. | 474/104 X |
| 3,559,859 | 2/1971 | McArthur | 226/19 |
| 3,765,161 | 10/1973 | Kohler | 57/88 |
| 3,769,786 | 11/1973 | Greive et al. | 57/105 |
| 4,040,244 | 8/1977 | Raschle | 57/105 |
| 4,051,056 | 10/1977 | Burri et al. | 57/105 |
| 4,193,254 | 3/1980 | Fusaroli | 57/105 |
| 4,286,706 | 9/1981 | Castelli et al. | 474/102 X |
| 4,635,431 | 1/1987 | Wolf | 57/105 |
| 4,691,508 | 9/1987 | Wolf | 57/105 X |
| 4,913,328 | 4/1990 | Schulz | 226/21 |

FOREIGN PATENT DOCUMENTS

| | | |
|---|---|---|
| 1510840 | 3/1970 | Fed. Rep. of Germany . |
| 62-250231 | 10/1987 | Japan . |

*Primary Examiner*—Stanley N. Gilreath

*Attorney, Agent, or Firm*—Evenson, Wands, Edwards, Lenahan & Mckeown

[57] ABSTRACT

In the case of a tangential belt drive for spinning or twisting machines having several rotating elements driven by a common tangential belt and having belt guiding members, which can be adjusted for correcting the moving direction of the tangential belt, it is provided that, along the tangential belt, several sensors are arranged which sense deviations from a given moving direction, and in the control elements are assigned to at least some of the belt guiding members, these control elements being controlled by an analyzing device which processes the signals of the sensors.

19 Claims, 2 Drawing Sheets

TANGENTIAL BELT DRIVE FOR SPINNING OR TWISTING MACHINES

BACKGROUND AND SUMMARY OF THE INVENTION

The invention relates to a tangential belt drive for spinning or twisting machines having several rotating elements, which are driven by a common tangential belt, and having adjustable belt guiding members for correcting the skitting of the predetermined desired path of the tangential belt laterally or transversely of its width.

In spinning or twisting machines having a tangential belt drive, the moving direction or travel path of the tangential belt laterally of its width must be adjusted. The individual tangential belts have irregularities, for example, in the area of their connecting point, which lead to deviations from a straight moving direction. In addition, tolerances in the arrangement of the driven rotating elements and in the arrangement of belt guiding members cause deviations from the straight moving direction. In particular, in the case of long spinning or twisting machines, the adjusting of the tangential belt with respect to its moving direction is a time-consuming operation which requires considerable practical experience. This adjusting is carried out by one or several operators. In this case, it is provided that, first, the placed tangential belt moves completely freely without driving any of the rotating elements. Subsequently, the individual rotating elements are consecutively applied to the tangential belt. During this operation, the moving direction of the tangential belt is observed. If a lateral deviating of the tangential belt should occur, it is attempted to prevent this deviating by the adjusting of belt guiding members, particularly of pressure rollers. In the course of this work, it becomes necessary to newly adjust the pressure rollers repeatedly. In practice, this operation is called "wobbling-in". The whole working Process is very expensive and may last up to several hours. An additional factor is that, deviations will occur repeatedly despite a careful manual adjusting since dirt and temperature changes or the like affect the moving behavior of the tangential belt. In addition, the moving behavior of the tangential belt and thus its moving direction may change, if one or several of the rotating elements, for example, for eliminating a yarn breakage, must be stopped. In addition, the adjusting must be carried out again when, after the old tangential belt is worn out, a new tangential belt must be inserted. Deviations in the moving direction of the tangential belt result in non-uniform loading of the rotating elements and thus in an increased wear of the belt.

An object of the invention is to construct a tangential belt drive of the initially mentioned type in such a manner that an increased precision is obtained with respect to maintaining the moving direction of the tangential belt.

This object is achieved according to preferred embodiments of the invention in that several sensors are arranged along the tangential belt, which detect deviations from a given moving direction, and in that control elements are assigned to at least some of the belt guiding members, which are each controlled by an analyzing device which processes the signals of the sensors.

In this manner, the tangential belt drive is provided with a control device by means of which the adjusting of an ideal belt moving direction takes place automatically. An adjusting of the moving direction of the tangential belt no longer has to be carried out by the operator, so that considerable time is saved during mounting.

In a first embodiment of the invention, it is provided that an analyzing device is assigned to each sensor and to each control element. The control element with its control device will then operate independently in the area of its influence. In this case, it is advantageous for the sensor to be arranged in moving direction of the tangential belt downstream of the belt guiding member controlled by it. As the result, the sensor can immediately examine the success of the correction initiated by it of the adjustment of the belt guiding member.

In another embodiment of the invention, it is provided that several or all sensors and control elements of one side of the machine are connected to a common analyzing device. This common analyzing device can then carry out a coordination of the adjustments over a larger machine section or even over the whole side of the machine.

In a further development of preferred embodiments of the invention, devices are provided for the switching-off of the analyzing device and/or of the control elements and/or of the sensors during the startup of the spinning or twisting machine. In this case, the machine starts up with the adjustment of the belt guiding members which they had when the machine was switched off. By means of tis switching-off, the situation is taken into account that, during the start-up, forces may occur which may lead to a deflection of the tangential belt and which deviate far from the conventional forces during the normal operation. Thus, an overreaction of the control device is avoided during the start-up.

It was known from German Published Examined Application (DE-A) 1 510 840 to provide a control device for a tangential belt drive, by means of which the pressure force of the tangential belt against the rotating elements to be driven can be adapted to the performance requirement, i.e., to the belt speed. However, this does not affect the moving direction of the tangential belt.

It is also known (JP-A 62-250231) to assign a tension detector to the tangential belt of a tangential belt drive which, by means of a corresponding control device, controls a tensioning device and thus automatically readjusts the belt tension. This device also does not affect the moving direction of the tangential belt.

Other objects, advantages and novel features of the present invention will become apparent from the following detailed description of the invention when considered in conjunction with the accompanying drawings.

DETAILED DESCRIPTION OF THE DRAWINGS

Figure 1:
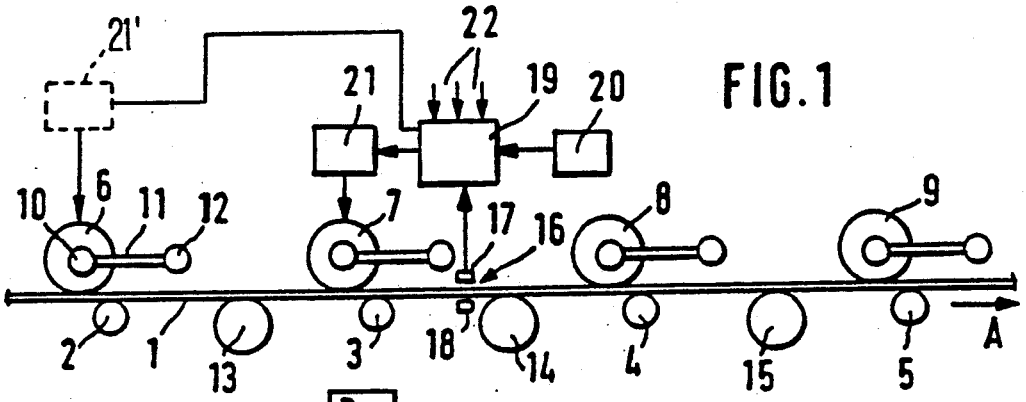
FIG. 1 is a schematic view of a section of a tangential belt drive for the driving of several rotating elements arranged in a row and with belt guiding devices of which one is provided with an automatic control device, constructed according to a preferred embodiment of the present invention.
Figure 1A:
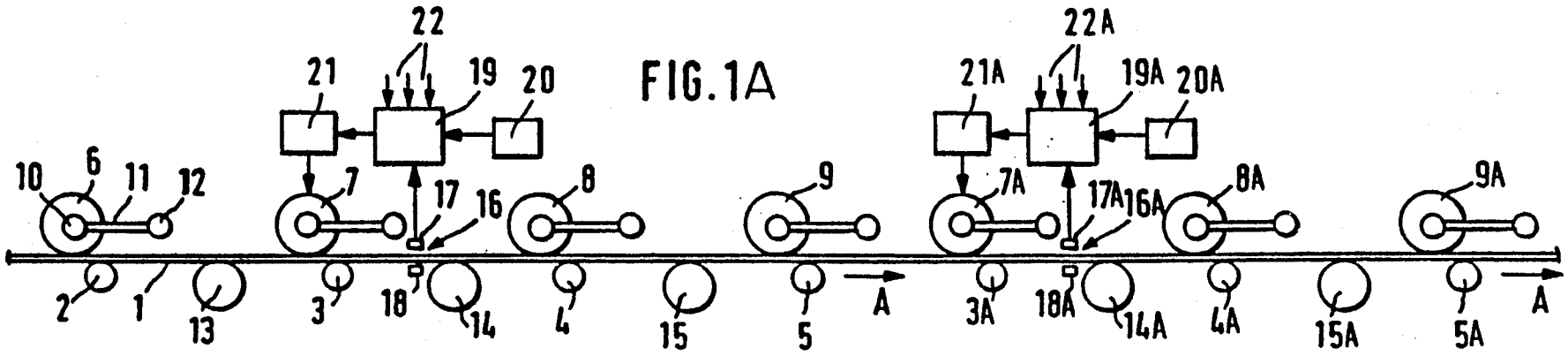
FIG. 1A schematically depicts an arrangement with additional elements similar to those shown and described with respect to FIG. 1, with the suffix "A" added for corresponding drawing reference characters.

FIG. 1 shows the driving end of a tangential belt 1 which drives a plurality of rotating elements 2, 3, 4, 5 which are arranged in a row on one side of the machine. In the embodiment, only four of these rotating elements 2, 3, 4, 5 are shown, also naturally many more of such rotating elements may be arranged on one side of the machine. FIG. 1A schematically depicts an arrangement with additional elements similar to those shown and described with respect to FIG. 1, with the suffix "A" added for corresponding drawing reference characters. In the case of open-end rotor spinning machines, for example, more than 100 such rotating elements 2, 3, 4, 5, which in this case are open-end spinning rotor shafts, may be arranged on one side of the machine. Between the individual rotating elements 2, 3, 4, 5, supporting rollers 13, 14, 15 are arranged, the connecting tangent of which is loaded slightly above the connecting tangent of the rotating elements 2, 3, 4, 5. On the opposite side, pressure rollers 6, 7, 8, 9 are arranged which each are assigned to one of the rotating elements 2, 3, 4, 5. These pressure rollers 6, 7, 8, 9 deflect the tangential belt 1 toward the rotating elements 2, 3, 4, 5 and press them with a defined force against the rotating elements 2, 3, 4, 5. The pressure rollers 6, 7, 8, 9 are rotatably arranged around a shaft 10 arranged on a swivel arm 11 which can be swivelled around a stationary shaft 12 and is located in the direction of the tangential belt 1 by a force generated by a spring or the like.

In order to align the tangential belt 1 moving in direction (A) in a moving direction which is as straight as possible, adjustable belt guiding members are provided at several points which are connected with a control device. In the shown embodiment, several pressure rollers are used as belt guiding devices; pressure roller 7 being one such pressure roller. Such adjustable belt guiding devices are arranged in a regularly spaced manner in longitudinal direction of the tangential belt 1, for example, within each section of the machine which is built in sections.

The control device contains sensors 16 (16*a*, 16*b* in FIG. 2) which sense the lateral position of the tangential belt 1; i.e., whether the tangential belt 1 deviates laterally to one side from its given straight moving direction. In the embodiment shown, optical sensors 16, 16*a*, 16*b* consisting of a light source 18 and a receiver 17 are arranged on both sides of the tangential belt 1. Other types of sensors are also contemplated, particularly since optical sensors tend to become dirty Foremost, capacitive or inductive sensors are appropriate. It is also contemplated to construct the sensors as mechanical sensors. The signals of the sensors 16, 16*a*, 16*b* are supplied to an analyzing device 19 which processes the signals and correspondingly controls a control element 21 by means of which the position of the pressure roller 7 may be changed.

The pressure roller 7, which is equipped with stop collars 23, 24, is disposed by means of its shaft 10A at the lever 11A. Lever 11A is pivotably held in a holding device 27 by means of the shaft 12A, which shaft 12A can be swivelled around a shaft 28 extending vertically with respect to the swivel shaft 12A. A piston 29 of the control element 21 is applied to the swivel arm 11A and can be adjusted in the direction of arrows (B) and (C) and, in the process, takes along the swivel arm 11A. By means of an oblique adjustment of the shaft 10A of the pressure roller 7 with respect to the longitudinal direction of the tangential belt 1, forces are generated by means of which this belt 1 is deflected into one or the other direction. In this case, relatively short adjusting paths are sufficient. Correspondingly, control elements 21 are provided which cover only short control paths in the case of a corresponding signal.

As shown in FIG. 1, an analyzing device 19 is provided for a plurality of adjustable belt guiding members (pressure rollers 7). As indicated by the arrows 22, the analyzing device 19 receives the signals from a plurality of sensors 16, 16*a*, 16*b*. As schematically depicted in dash lines, multiple control elements 21, 21' are connected to the common analyzing device 19, which can then carry out a coordination of adjustments over a larger machine section or even over the whole side of the machine. The analyzing of these signals takes place according to a program which is entered by means of a program input unit 20 to the analyzing device 19.

FIG. 1A schematically depicts an arrangement with additional elements similar to those shown and described with respect to FIG. 1, with the suffix "A" added for corresponding drawing reference characters. In this FIG. 1A arrangement, an analyzing device 19, 19*a* is assigned to each set of sensors 16, 16A and to each control element 21, 21A. The control elements will then operate independently in the area of their respective influence. Advantageously, the sensors are arranged in the moving direction of the tangential belt downstream of the belt guiding member controlled by it. Consequently, the sensor can immediately examine the success of the correction initiated by it of the adjustment of the belt guiding member.

Figure 2:
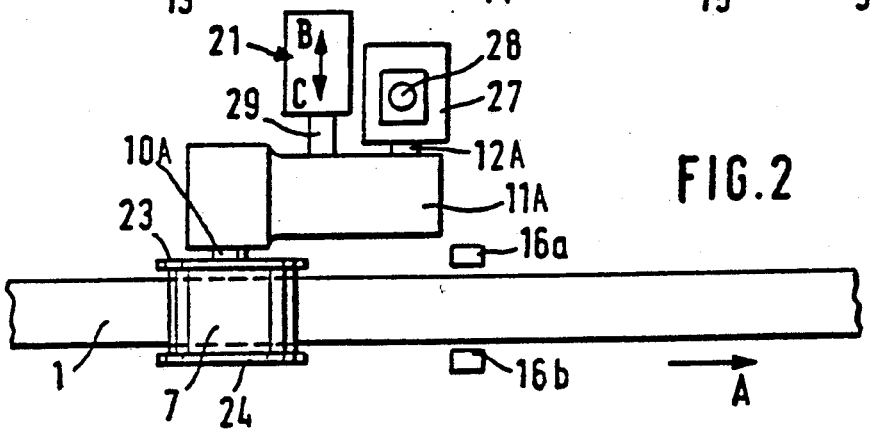
FIG. 2 is a slightly enlarged top view of the tangential belt drive according to FIG. 1.

As a modification of the shown embodiment according to FIG. 1 and 2, a holding device of the pressure rollers 7 can be moved in two levels (laterally of the belt width and perpendicular to the belt surface) is not necessary. In this case, it is provided that the swivel arm 11 can be elastically deformed transversely with respect to the moving direction of the tangential belt 1 so that it can be deformed correspondingly by the control element 21 and in the process swivels the pressure roller 7. Because of the relatively short control paths, this is easily possible. However, this means that the control element 21 itself must stop itself in the respective adjusted position.

Figure 3:
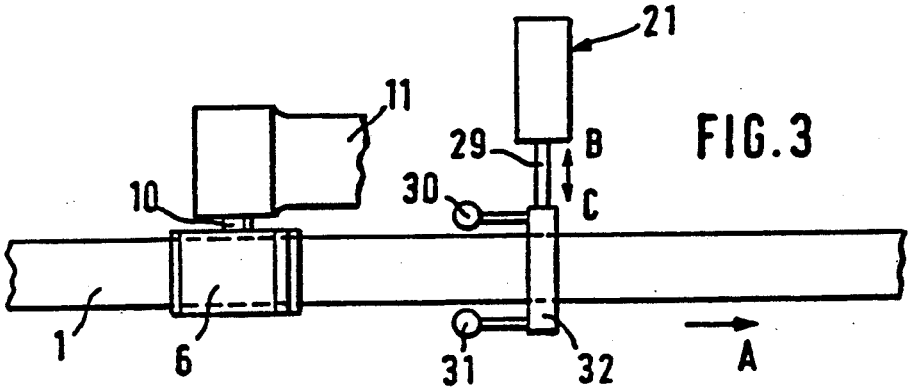
FIG. 3 is a top view of another embodiment of the invention with an additional belt guiding device.

In the embodiment according to FIG. 3, a belt guiding member is provided which is independent of the normally existing belt guiding members, the pressure rollers 6, 7, 8, 9 and the supporting rollers 13, 14, 15, and which is adjustable by means of a control element 21. This belt guiding element is constructed in the form of a two-pronged fork and has a common holder 32 for two stops 30, 31 arranged laterally of the tangential belt 1 which are assigned to the faces of the tangential belt 1 and which expediently are constructed as easily rotatable rollers.

Small step motors or small geared motors with a large gear reduction, which therefore permit short control paths, are suitable for use as control elements 21.

In a modified embodiment, a main deflection pulley in the area of one machine end and/or, if necessary, the driving disk which drives the tangential belt 1 at the other machine end are also provided as adjustable belt guiding members. In this case, a corresponding bearing must be provided for the deflection pulley and/or the driving disk, which permits a pivotable and skew adjustment.

In a further development of the invention, the sensors 16, 16*a*, 16*b* may also take over the task of providing information on the edges of the tangential belt; i.e., continuously checking the wear of the tangential belt. This determination may also be made indirectly by the analyzing device 19 since a tangential belt 1, which exhibits considerable wear, runs less quietly and deviates from its straight moving direction more frequently. The frequency of the control steps is therefore an indication of wear. This may be utilized for reading the condition of the tangential belt 1 by means of an indicating device. As a further development, it will then be possible to sense and analyze the condition of the tangential belts of all spinning machines at a central location so that a plan can be established for the corresponding servicing work for the exchange of the tangential belts.

In some cases, it will also be possible to analyze, by means of the analyzing device 19, the condition of the rotating elements to be driven. If, for example, at a spinning or testing point of a machine, the bearing of a rotating element 2, 3, 4, 5 has failed, this stopped rotating element 2, 3, 4 or 5 causes a deviation of the belt path from the ideal state. In this case, by means of a time function element, this deviation can be determined to be a damage requiring a servicing. The analyzing device can then emit an emergency signal which will call the operator.

In another embodiment, a sensor may also be assigned to the swivel arms 11 of the pressure rollers 6, 7, 8, 9, this sensor being connected with the analyzing device 19. By means of the position of the swivel arm 11, information can be obtained concerning the belt tension which can then be readjusted correspondingly at the main belt tensioning device.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A tangential belt drive control arrangement for spinning or twisting machines having several rotating spinning or twisting elements, which are driven by a common tangential belt which is selectively pressed by pressing means against the rotating spinning or twisting elements to drive the same, said control arrangement comprising:

belt travel path sensing means for sensing transverse deviations between the actual belt travel path and a predetermined desired belt travel path, and belt travel path control means for automatically controlling the belt travel path in response to signals from the belt travel path sensing means to control said transverse deviations without interrupting the continuous movement of the belt to drive the rotating elements.

2. A tangential belt drive control arrangement according to claim 1, wherein adjustable belt guiding members are provided for guiding the belt during normal operations, and wherein said belt travel path control means includes means for controlling the position of at least one of the adjustable belt guiding members.

3. A tangential belt drive control arrangement according to claim 2, wherein said belt guiding members deflect the tangential belt against the rotating elements.

4. A tangential belt drive control arrangement according to claim 3, wherein supporting rollers for the tangential belt are disposed to engage the tangential belt at its side opposite the belt guiding members.

5. A tangential belt drive control arrangement according to claim 2, wherein supporting rollers for the tangential belt are disposed to engage the tangential belt at its side opposite the belt guiding members.

6. A tangential belt drive control arrangement according to claim 1, wherein said belt travel path sensing means includes a plurality of belt path sensors disposed along the belt travel path; and wherein said belt travel path control means includes an analyzing device assigned to each sensor.

7. A tangential belt drive control arrangement according to claim 6, wherein said belt travel path control means includes a plurality of belt engaging means disposed along the belt travel path, and wherein a set of sensors is assigned to each belt engaging means with separate control of each set of sensors and belt engaging means.

8. A tangential belt drive control arrangement according to claim 7, wherein the sensors are arranged downstream of the belt guiding means controlled by it, in the moving direction of the belt.

9. A tangential belt drive control arrangement according to claim 7, wherein said control means includes a common analyzing device assigned to a plurality of the sets of sensors and belt engaging means.

10. A tangential belt drive control arrangement according to claim 9, wherein a program input unit is connected to the analyzing device for controlling the analyses of signals from the plurality of sensors.

11. A tangential belt drive control arrangement according to claim 9, wherein devices are provided for the switching-off of the analyzing device and/or of the control elements and/or of the sensors during the startup of the spinning or twisting machine.

12. A tangential belt drive control arrangement according to claim 7, wherein said plurality of belt engaging means are belt guiding members.

13. A tangential belt drive control arrangement according to claim 6, wherein said control means includes a common analyzing device assigned to a plurality of sensors.

14. A tangential belt drive control arrangement according to claim 13, wherein a program input unit is connected to the analyzing device for controlling the analyses of signals from the plurality of sensors.

15. A tangential belt drive control arrangement according to claim 13, wherein devices are provided for the switching-off of the analyzing device and/or of the control elements and/or of the sensors during the startup of the spinning or twisting machine.

16. A tangential belt drive control arrangement according to claim 1, wherein adjustable belt guiding member are provided for guiding the belt during normal operations, and wherein pressure rollers are provided as the adjustable belt guiding members, which pressure rollers are held by means of a control element of an adjustable holding device.

17. A tangential belt drive control arrangement according to claim 1, wherein said belt travel path control means include stops provided as belt guiding members on both sides of the tangential belt, these stops being arranged on a holding device which can be adjusted transversely with respect to the tangential belt by means of a control element of the control means.

18. A tangential belt drive control arrangement according to claim 1, wherein said rotating elements are rotor shafts of an open-end rotor spinning machine.

19. A tangential belt drive control arrangement according to claim 1, wherein said belt travel path control means includes an analyzing unit for analyzing signals from the belt travel path sensing means to thereby effect control of the belt travel path.

* * * * *